US008616021B2

(12) United States Patent
Minta

(10) Patent No.: US 8,616,021 B2
(45) Date of Patent: Dec. 31, 2013

(54) NATURAL GAS LIQUEFACTION PROCESS

(75) Inventor: Moses Minta, Missouri City, TX (US)

(73) Assignee: ExxonMobil Upstream Research Company, Houston, TX (US)

( * ) Notice: Subject to any disclaimer, the term of this patent is extended or adjusted under 35 U.S.C. 154(b) by 718 days.

(21) Appl. No.: 12/527,539

(22) PCT Filed: Mar. 4, 2008

(86) PCT No.: PCT/US2008/002861

§ 371 (c)(1),
(2), (4) Date: Aug. 17, 2009

(87) PCT Pub. No.: WO2008/136884

PCT Pub. Date: Nov. 13, 2008

(65) Prior Publication Data

US 2010/0107684 A1 May 6, 2010

Related U.S. Application Data

(60) Provisional application No. 60/927,340, filed on May 3, 2007.

(51) Int. Cl.
*F25J 3/00* (2006.01)

(52) U.S. Cl.
USPC ..... 62/613; 62/606; 62/611; 62/612

(58) Field of Classification Search
USPC ..... 62/611, 612, 613, 606, 113, 614
See application file for complete search history.

(56) References Cited

U.S. PATENT DOCUMENTS 3,162,519 A 12/1964 Peters et al.
3,323,315 A 6/1967 Carr (Continued)

FOREIGN PATENT DOCUMENTS

DE 195 17 116 C1 6/1996
WO WO 95/27179 A1 10/1995
WO WO 2007/021351 A1 2/2007

OTHER PUBLICATIONS

Christiansen, C. et al, "Offshore Natural Gas Liquefaction Process for High-Pressure Gas Fields", AICHE Spring National Meeting, Mar. 5-9, 2000, 8 pages, Atlanta, GA.

(Continued)

*Primary Examiner* — Frantz Jules
*Assistant Examiner* — Keith Raymond
(74) *Attorney, Agent, or Firm* — ExxonMobil Upstream Research Company Law Department

(57) ABSTRACT

The invention relates to a process for liquefying a gas stream rich in methane, said process comprising: (a) providing said gas stream; (b) withdrawing a portion of said gas stream for use as a refrigerant; (c) compressing said refrigerant; (d) cooling said compressed refrigerant with an ambient temperature cooling fluid; (e) subjecting the cooled, compressed refrigerant to supplemental cooling; (f) expanding the refrigerant of (e) to further cool said refrigerant, thereby producing an expanded, supplementally cooled refrigerant; (g) passing said expanded, supplementally cooled refrigerant to a heat exchange area; and, (h) passing said gas stream of (a) through said heat exchange area to cool at least part of said gas stream by indirect heat exchange with said expanded, supplementally cooled refrigerant, thereby forming a cooled gas stream. In further embodiments for improved efficiencies, additional supplemental cooling may be provided after one or more other compression steps.

10 Claims, 3 Drawing Sheets

(56) References Cited

U.S. PATENT DOCUMENTS

| | | | | | |
|---|---|---|---|---|---|
| 3,383,873 | A | | 5/1968 | Becker | |
| 3,407,052 | A | | 10/1968 | Huntress et al. | |
| 3,511,058 | A | | 5/1970 | Becker | |
| 3,616,652 | A | * | 11/1971 | Engel | 62/613 |
| 3,818,714 | A | | 6/1974 | Etzbach et al. | |
| 4,582,519 | A | | 4/1986 | Someya et al. | |
| 4,740,223 | A | | 4/1988 | Gates | |
| 4,755,200 | A | | 7/1988 | Liu et al. | |
| 5,036,671 | A | | 8/1991 | Nelson et al. | |
| 5,651,269 | A | * | 7/1997 | Prevost et al. | 62/613 |
| 5,669,234 | A | | 9/1997 | Houser et al. | |
| 5,755,114 | A | | 5/1998 | Foglietta | |
| 5,768,912 | A | | 6/1998 | Dubar | |
| 5,826,444 | A | | 10/1998 | Capron et al. | |
| 5,836,173 | A | | 11/1998 | Lynch et al. | |
| 5,931,021 | A | | 8/1999 | Shnaid et al. | |
| 5,983,665 | A | | 11/1999 | Howard et al. | |
| 5,992,175 | A | | 11/1999 | Yao et al. | |
| 6,006,545 | A | | 12/1999 | Tranier | |
| 6,023,942 | A | | 2/2000 | Thomas et al. | |
| 6,062,041 | A | | 5/2000 | Kikkawa et al. | |
| 6,070,429 | A | | 6/2000 | Low et al. | |
| 6,085,545 | A | | 7/2000 | Johnston | |
| 6,105,389 | A | | 8/2000 | Paradowski et al. | |
| 6,105,391 | A | | 8/2000 | Capron | |
| 6,220,053 | B1 | | 4/2001 | Hass, Jr. et al. | |
| 6,250,244 | B1 | | 6/2001 | Dubar et al. | |
| 6,269,655 | B1 | | 8/2001 | Roberts et al. | |
| 6,269,656 | B1 | | 8/2001 | Johnston | |
| 6,308,531 | B1 | | 10/2001 | Roberts et al. | |
| 6,378,330 | B1 | | 4/2002 | Minta et al. | |
| 6,389,844 | B1 | | 5/2002 | Klein Nagel Voort | |
| 6,412,302 | B1 | * | 7/2002 | Foglietta | 62/611 |
| 6,446,465 | B1 | | 9/2002 | Dubar | |
| 6,449,982 | B1 | | 9/2002 | Fischer | |
| 6,484,533 | B1 | | 11/2002 | Allam et al. | |
| 6,564,578 | B1 | | 5/2003 | Fischer-Calderon | |
| 6,581,409 | B2 | | 6/2003 | Wilding et al. | |
| 6,694,774 | B1 | | 2/2004 | Rashad et al. | |
| 6,722,157 | B1 | | 4/2004 | Eaton et al. | |
| 6,742,357 | B1 | | 6/2004 | Roberts | |
| 6,751,985 | B2 | | 6/2004 | Kimble et al. | |
| 6,763,680 | B2 | | 7/2004 | Fischer et al. | |
| 6,886,362 | B2 | | 5/2005 | Wilding et al. | |
| 6,889,523 | B2 | | 5/2005 | Wilkinson et al. | |
| 6,962,061 | B2 | | 11/2005 | Wilding et al. | |
| 7,000,427 | B2 | | 2/2006 | Mathias et al. | |
| 7,086,251 | B2 | | 8/2006 | Roberts | |
| 7,127,914 | B2 | * | 10/2006 | Roberts et al. | 62/612 |
| 7,204,100 | B2 | | 4/2007 | Wilkinson et al. | |
| 7,234,321 | B2 | | 6/2007 | Maunder et al. | |
| 2003/0089125 | A1 | | 5/2003 | Fredheim et al. | |
| 2004/0187520 | A1 | | 9/2004 | Wilkinson et al. | |
| 2004/0255616 | A1 | | 12/2004 | Maunder et al. | |
| 2005/0268649 | A1 | | 12/2005 | Wilkinson et al. | |
| 2006/0090508 | A1 | * | 5/2006 | Howard | 62/613 |
| 2009/0217701 | A1 | * | 9/2009 | Minta et al. | 62/612 |

OTHER PUBLICATIONS

Foglietta, J. H., "Consider dual independent expander refrigeration for LNG production: New methodology may enable reducing cost to produce stranded gas", *Hydrocarbon Processing*, Jan. 2004, pp. 39-44, Gulf Publishing, vol. 83, No. 1, Houston, TX.

Muller, K. et al., "Natural-Gas Liquefaction by an Expansion-Turbine Mixture Cycle", *Chemical Economy and Engineering Review* (*CEER*), *Chemical Economy Research Institute*, Oct. 1976, pp. 15-18,29, vol. 8, No. 10.

European Search Report No. 115442, Oct. 31, 2007, 4 pages.

* cited by examiner

NATURAL GAS LIQUEFACTION PROCESS

PRIORITY CLAIM

This application is the National Stage of International Application No. PCT/US2008/002861, filed 4 Mar. 2008, which claims the benefit of U.S. Provisional Application No. 60/927,340, filed 3 May, 2007.

TECHNICAL FIELD

Embodiments of the invention relate to a process for liquefaction of natural gas and other methane-rich gas streams, and more particularly to a process for producing liquefied natural gas (LNG).

BACKGROUND

Because of its clean burning qualities and convenience, natural gas has become widely used in recent years. Many sources of natural gas are located in remote areas, great distances from any commercial markets for the gas. Sometimes a pipeline is available for transporting produced natural gas to a commercial market. When pipeline transportation is not feasible, produced natural gas is often processed into liquefied natural gas (which is called "LNG") for transport to market.

In designing an effective and efficient LNG plant, that is an industrial process facility designed to conduct the conversion of natural gas, from gaseous form to liquid, many refrigeration cycles have been used to liquefy natural gas by cooling. The three types most commonly used in LNG plants today are: (1) the "cascade cycle," which uses multiple single component refrigerants in heat exchangers arranged progressively to reduce the temperature of the gas to a liquefaction temperature; (2) the "multi-component refrigeration cycle," which uses a multi-component refrigerant in specially designed exchangers; and (3) the "expander cycle," which expands gas from feed gas pressure to a low pressure with a corresponding reduction in temperature. Variants of the last cycle, the expander cycle, have been found to provide substantial contribution to the state of the art, see WO-A-2007/021351, published 22 Feb., 2007. As described here, using a portion of the feed gas stream in a high pressure expander loop can contribute a refrigerant stream for heat exchange treatment of that feed gas and this largely permits the elimination of external refrigerants while improving overall efficiencies.

However, though a significant improvement over prior art processes using expander cooling cycles, the process of WO-A-2007/021351 can still suffer thermodynamic inefficiencies, particularly where high local ambient temperatures prevent effective use of ambient temperature air or water cooling to achieve effective lowering of the temperatures of process gas or liquid streams. And, where colder water is theoretically available in lower depths of water even though ambient surface temperatures are high, there may be significant costs associated with placing and operating access piping for carrying deep waters to a LNG platform, specifically floating production system. The constant movement of a floating production system places stresses and strains on pivoted piping extending down from the platform, thus raising structural support problems. Also the amount of water needed can require high horsepower pumps if the depth is much below the surface, obviously increasing with the depth of the cooler water sought.

The goal for LNG liquefaction process development is to try to match the natural gas cooling curve with the refrigerant warming curve. For liquefaction systems based on refrigerants, this means splitting the refrigerant into two streams which are cooled to different temperatures. Typically, the cold end is cooled by a refrigerant whose composition is chosen such that the warming curve best matches the natural gas cooling curve for the cold temperature range. The warm end is typically cooled with propane for economic reasons but again a refrigerant with a chosen composition may be used to better match the natural gas cooling curve for the warm end. Furthermore, for liquefaction processes operating at high ambient temperatures, the pre-cooling (warm end) refrigeration system would become excessively large and costly. In the process of WO-A-2007/021351, this may represent over 70% of the installed compression horsepower. The classic approach is to further split the cooling temperature range and add another refrigeration loop. This is typical of the cascade liquefaction cycle which typically involves three refrigerants. This adds to the complexity of the process and results in increased equipment count as well as cost.

Accordingly, there is still a need for a high-pressure expander cycle process providing improved efficiencies where ambient temperatures of air and water do not provide sufficient cooling to minimize power required and the costs therewith for the overall cycle. In particular a process that can reduce the overall horsepower requirements of natural gas liquefaction facility, particularly one operating in high ambient temperatures is still of high interest.

Other related information may be found in International Publication No. WO2007/021351; Foglietta, J. H., et al., "Consider Dual Independent Expander Refrigeration for LNG Production New Methodology May Enable Reducing Cost to Produce Stranded Gas," Hydrocarbon Processing, Gulf Publishing Co., vol. 83, no. 1, pp. 39-44 (January 2004); U.S. App. No. US2003/089125; U.S. Pat. No. 6,412,302; U.S. Pat. No. 3,162,519; U.S. Pat. No. 3,323,315; and German Pat. No. DE19517116.

SUMMARY OF THE INVENTION

The invention is a process for liquefying a gas stream rich in methane, said process comprising: (a) providing said gas stream at a pressure less than 1,200 psia; (b) withdrawing a portion of said gas stream for use as a refrigerant; (c) compressing said refrigerant to a pressure greater than its pressure in (a) to provide a compressed refrigerant; (d) cooling said compressed refrigerant by indirect heat exchange with an ambient temperature cooling fluid to a process temperature above about 35 degrees Fahrenheit; (e) subjecting the cooled, compressed refrigerant to supplemental cooling so as to reduce further its temperature thereby producing a supplementally cooled, compressed refrigerant; (f) expanding the refrigerant of (e) to further cool said refrigerant, thereby producing an expanded, supplementally cooled refrigerant, wherein the supplementally cooled, compressed refrigerant of (e) is from 10° F. to 70° F. (6° C. to 39° C.) cooler than said process temperature; (g) passing said expanded, supplementally cooled refrigerant to a heat exchange area; and, (h) passing said gas stream of (a) through said heat exchange area to cool at least part of said gas stream by indirect heat exchange with said expanded, supplementally cooled refrigerant, thereby forming a cooled fluid stream. This cooled stream may comprise cooled gas, a two-phase mixture of gas and liquefied gas, or sub-cooled liquefied gas, depending upon the pressure of the gas. In further embodiments for improved efficiencies, supplemental cooling may be provided after one or more other compression steps for the refrigerant, if more than one, for recycled vapor gases recovered from the LNG and for the feed gas itself prior to entering the primary heat exchange area.

DETAILED DESCRIPTION

Embodiments of the present invention provide a process for natural gas liquefaction using primarily gas expanders plus strategically placed external refrigerant, supplemental cooling to minimize the overall horsepower requirements for the total gas liquefaction process. Such liquefaction cycles require, in addition to the high pressure cooling loop, only supplemental cooling using external closed-loop refrigerants, and such supplemental cooling units can be optimally sized to maximize the thermodynamic efficiency of a purely gas expander process for given ambient conditions, while reducing overall horsepower requirements and thus power consumed. Since preferred expander processes use ambient-temperature water or air as the only external sources of cooling fluids, which are used for compressor inter-stage or after cooling, the invention process enables better, more efficient operation.

The gas expander process of WO2007/021351 (the '351 application) is representative of a high efficiency natural gas liquefaction process. In the '351 application there is a refrigerant loop that generally comprises a step of cooling the refrigerant by indirect heat exchange with ambient temperature air or water after it has been heated by the step of compressing the refrigerant stream to the high pressure at which the high pressure expander loop is operated. After the heat exchange cooling is conducted, the high pressure refrigerant is then expanded in one or more turbo-expanders for further cooling before it is conducted to a heat exchange apparatus for cooling of the feed gas stream. The thus cooled feed gas stream becomes liquid, at least in part, and is further cooled if needed, separated from any remaining gas vapors and available as LNG.

Figure 1:
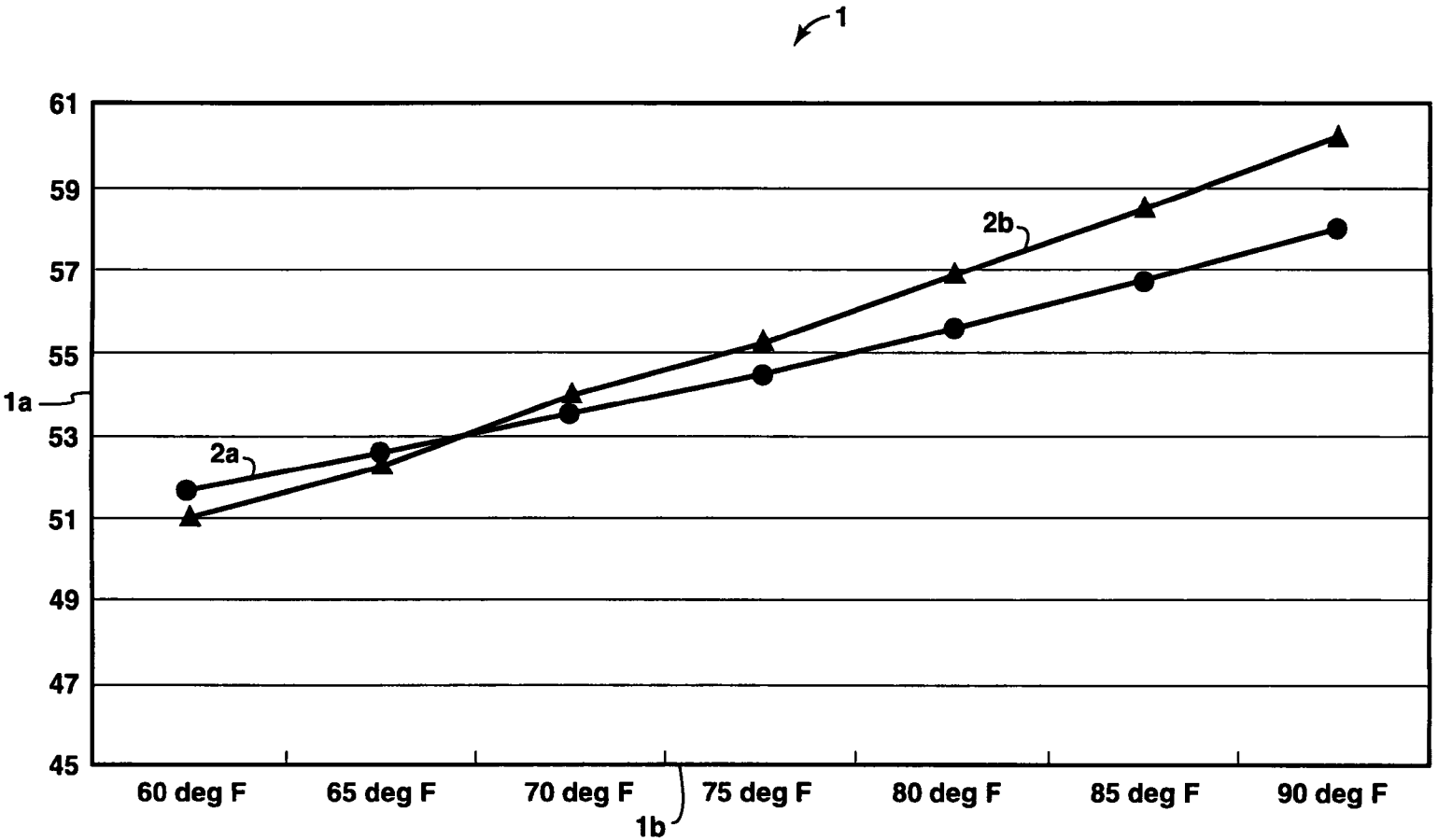
FIG. 1 is a graphic illustration comparing power usage of different cooling processes.

In at least one embodiment of the '351 application, the process was found to be about as efficient or less efficient than a standard mixed refrigerant process at temperatures above about 65 degrees Fahrenheit (° F.). FIG. 1 is a graphic illustration comparing power usage of different cooling processes. Graph 1 shows net power on the vertical axis 1*a* versus process temperature on the horizontal axis 1*b*. Note that the process temperature is generally a few degrees higher than the ambient temperature. For example, the process temperature may be from about 1 to about 5 degrees Fahrenheit warmer than the ambient temperature. The line 2*a* represents the mixed refrigerant case and the line 2*b* represents one embodiment of the pressurized cooling cycle of the '351 application. As shown, the net power requirement for the mixed refrigerant cycle 2*a* appears to be the same or lower than the net power requirement for the pressurized cooling cycle 2*b* at temperatures above about 65° F.

It has been found that significant efficiencies can be achieved if additional external, supplemental cooling of the refrigerant is provided after the indirect heat exchange but prior to expanding the refrigerant for last cooling, and before being provided to the heat exchange area where the gas feed stream is principally cooled. Generally speaking, the refrigeration horsepower required to cool any object increases with increasing ambient temperature where the heat removed (by cooling) must be rejected. Further, the substantial amount of energy that must be removed to liquefy natural gas depends on the initial temperature of the gas—the higher the temperature, the higher the energy that must be removed, and thus the refrigeration requirements. Accordingly, the horsepower requirement for LNG liquefaction increases with ambient temperature which sets the initial (process) temperature of the feed stream and the process streams. The ambient temperature determines the initial temperature of the natural gas feed stream as well as the refrigerant stream because an ambient medium (air or water) is used typically for the initial cooling of the feed stream and in refrigerant compressor intercoolers and after-coolers. Thus the initial natural gas feed and compressed refrigerant temperatures are generally about 5° F. (2.8° C.) above the ambient temperature (e.g. the process temperature).

For the purposes of this description, and claims, the terms "supplemental cooling" and "external cooling" are used interchangeably, and each refers to one or more refrigeration units using traditional refrigeration cycles with refrigerants independent of the refrigerant stream being processed. In view of the refrigerant stream being taken off the feed stream, its temperature range is typically near ambient temperature; essentially any of the common external refrigerant systems will be suitable. Conventional chiller packages are well-suited and add only minimally to the power generation requirement for the whole facility. The refrigerants in this external cooling system may be any of the known refrigerants, including fluoro-carbons e.g., R-134a (tetrafluoromethane), R-410a (a 50/50 mixture of difluoromethane (R-32) and pentafluoroethane (R-125)), R-116 (hexafluoroethane), R-152a (difluoroethane), R-290 (propane), and R-744 (carbon dioxide), etc. For off-shore LNG platforms, where minimizing equipment is important, non-CFC (chlorofluorocarbon)-based refrigerants may be used to minimize the required refrigerant flow rate and thus allow reduced size equipment.

External refrigeration sources require power. The power depends on two primary parameters: the quantity of refrigeration (amount of cooling required) and the temperature at which the cooling is required. The lower the temperature to which the cooling is required to effect (i.e. the bigger the temperature difference from the ambient), the higher the refrigeration power. Further, the greater the temperature differences from the ambient, the higher the cooling load (amount of cooling required), and consequently, the power requirement. Thus the power requirement for the external refrigeration source quickly increases with decreasing target temperatures for the process stream (or increasing temperature difference from the ambient). For very large temperature differences, the external refrigeration power can become a significant fraction of the total installed horsepower thus causing a loss of overall process efficiency. It has been discovered that an effective cooling target is a temperature reduction between 30° F. (17° C.) and 70° F. (39° C.) lower than ambient temperature, especially when such ambient temperatures are between 50° F. and 110° F. (10° C. and 44° C.).

Figure 2:
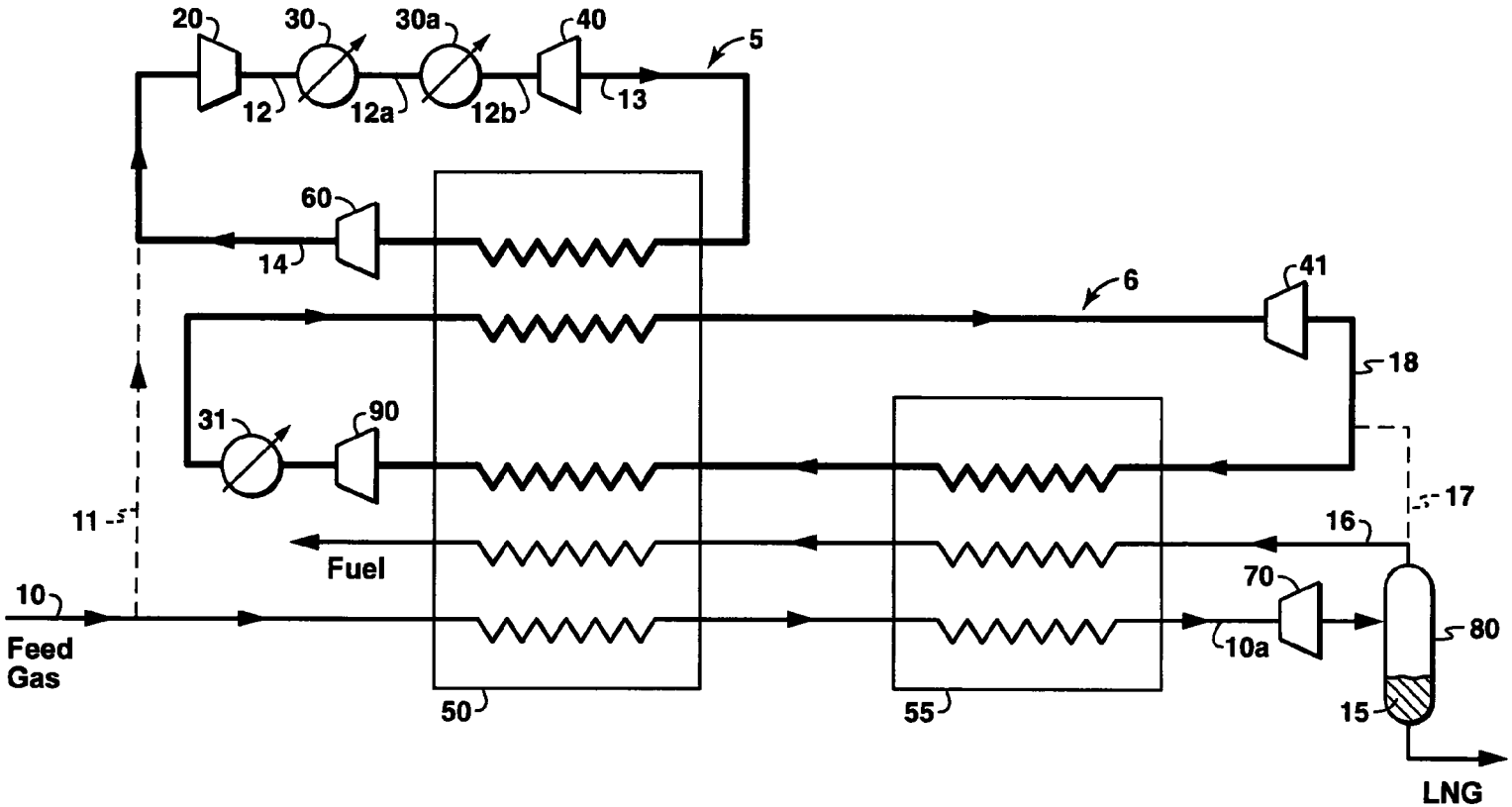
FIG. 2 is a schematic flow diagram of one embodiment for producing LNG in accordance with the process of this invention where supplemental cooling is provided in the high pressure refrigerant loop after ambient cooling by indirect heat exchange.

FIG. 2 illustrates one embodiment of the present invention in which an expander loop 5 (i.e., an expander cycle) and a sub-cooling loop 6 are used. For clarity, expander loop 5 and sub-cooling loop 6 are shown with double-width lines in FIG. 2. In this specification and the appended claims, the terms "loop" and "cycle" are used interchangeably. In FIG. 2, feed gas stream 10 enters the liquefaction process at a pressure less than about 1,200 psia (8273.8 kPa), or less than about 1,100 psia (7584.2 kPa), or less than about 1,000 psia (6894.8 kPa), or less than about 900 psia (6205.3 kPa), or less than about 800 psia (5515.8 kPa), or less than about 700 psia (4826.3 kPa), or less than about 600 psia (4136.9 kPa). Typically, the pressure of feed gas stream 10 will be about 800 psia (5515.8 kPa). Feed gas stream 10 generally comprises natural gas that has been treated to remove contaminants using processes and equipment that are well known in the art. Optionally, before being passed to a heat exchanger, a portion of feed gas stream 10 is withdrawn to form side stream 11, thus providing, as will be apparent from the following discussion, a refrigerant at a pressure corresponding to the pressure of feed gas stream 10, namely any of the above pressures, including a pressure of less than about 1,200 psia. The refrigerant may be any suitable gas component, preferably one available at the processing facility, and most preferably, as shown, is a portion of the methane-rich feed gas. Thus, in the embodiment shown in FIG. 2, a portion of the feed gas stream is used as the refrigerant for expander loop 5. Although the embodiment shown in FIG. 2 utilizes a side stream that is withdrawn from feed gas stream 10 before feed gas stream 10 is passed to a heat exchanger, the side stream of feed gas to be used as the refrigerant in expander loop 5 may be withdrawn from the feed gas after the feed gas has been passed to a heat exchange area. Thus, in one or more embodiments, the present method is any of the other embodiments herein described, wherein the portion of the feed gas stream to be used as the refrigerant is withdrawn from the heat exchange area, expanded, and passed back to the heat exchange area to provide at least part of the refrigeration duty for the heat exchange area.

Side stream 11 is passed to compression unit 20 where it is compressed to a pressure greater than or equal to about 1,500 psia (10,342 kPa), thus providing compressed refrigerant stream 12. Alternatively, side stream 11 is compressed to a pressure greater than or equal to about 1,600 psia (11,031 kPa), or greater than or equal to about 1,700 psia (11,721 kPa), or greater than or equal to about 1,800 psia (12,411 kPa), or greater than or equal to about 1,900 psia (13,100 kPa), or greater than or equal to about 2,000 psia (13,799 kPa), or greater than or equal to about 2,500 psia (17,237 kPa), or greater than or equal to about 3,000 psia (20,864 kPa), thus providing compressed refrigerant stream 12. As used in this specification, including the appended claims, the term "compression unit" means any one type or combination of similar or different types of compression equipment, and may include auxiliary equipment, known in the art for compressing a substance or mixture of substances. A "compression unit" may utilize one or more compression stages. Illustrative compressors may include, but are not limited to, positive displacement types, such as reciprocating and rotary compressors for example, and dynamic types, such as centrifugal and axial flow compressors, for example.

After exiting compression unit 20, compressed refrigerant stream 12 is passed to cooler 30 where it is cooled by indirect heat exchange with ambient air or water to provide a compressed, cooled refrigerant 12*a*. The temperature of the compressed refrigerant stream 12*a* as it emerges from cooler 30 depends on the ambient conditions and the cooling medium used and is typically from about 35° F. (1.7° C.) to about 105° F. (40.6° C.). Preferably where the ambient temperature is in excess of about 50° F. (10° C.), more preferably in excess of about 60° F. (15.6° C.), or most preferably in excess of about 70° F. (21.1° C.), the stream 12*a* is additionally passed through a supplemental cooling unit 30*a*, operating with external coolant fluids, such that the compressed refrigerant stream 12*b* exits said cooling unit 30*a* at a temperature that is from about 10° F. to about 70° F. (5.6° C. to 38.9° C.) cooler than the ambient temperature, preferably at least about 15° F. (8.3° C.) cooler, more preferably at least about 20° F. (11.1° C.) cooler. Note that cooling unit 30*a* comprises one or more external refrigeration units using traditional refrigeration cycles with external refrigerants independent of the refrigerant stream 12.

The supplementally cooled compressed refrigerant stream 12*b* is then passed to expander 40 where it is expanded and consequently cooled to form expanded refrigerant stream 13. In one or more embodiments, expander 40 is a work-expansion device, such as gas expander turbine producing work that may be extracted and used separately, e.g., for compression. Since the entering stream 12*b* is cooler than it would be without the supplemental cooling in unit 30*a*, the expansion in expander 40 is operated with a lower inlet temperature of refrigerant which results in a higher turbine discharge pressure and consequently lower compression horsepower requirements. Further, the efficiency of the heat exchange unit 50 improves from the higher discharge pressure which reduces the required expander turbine flow rate and thus the compression horsepower requirements for the loop 5.

Expanded refrigerant stream 13 is passed to heat exchange area 50 to provide at least part of the refrigeration duty for heat exchange area 50. As used in this specification, including the appended claims, the term "heat exchange area" means any one type or combination of similar or different types of equipment known in the art for facilitating heat transfer. Thus, a "heat exchange area" may be contained within a single piece of equipment, or it may comprise areas contained in a plurality of equipment pieces. Conversely, multiple heat exchange areas may be contained in a single piece of equipment.

Upon exiting heat exchange area 50, expanded refrigerant stream 13 is fed to compression unit 60 for pressurization to form stream 14, which is then joined with side stream 11. It will be apparent that once expander loop 5 has been filled with feed gas from side stream 11, only make-up feed gas to replace losses from leaks is required, the majority of the gas entering compressor unit 20 generally being provided by stream 14. The portion of feed gas stream 10 that is not withdrawn as side stream 11 is passed to heat exchange area 50 where it is cooled, at least in part, by indirect heat exchange with expanded refrigerant stream 13 and becomes a cooled fluid stream that may comprise liquefied gas, cooled gas, and/or two-phase fluids comprising both, and mixtures thereof. After exiting heat exchange area 50, feed gas stream 10 is optionally passed to heat exchange area 55 for further cooling. The principal function of heat exchange area 55 is to sub-cool the feed gas stream. Thus, in heat exchange area 55 feed gas stream 10 is preferably sub-cooled by a sub-cooling loop 6 (described below) to produce sub-cooled fluid stream 10*a*. Sub-cooled fluid stream 10*a* is then expanded to a lower pressure in expander 70, thereby cooling further said stream, and at least partially liquefying sub-cooled fluid stream 10*a* to form a liquid fraction and a remaining vapor fraction. Expander 70 may be any pressure reducing device, including, but not limited to a valve, control valve, Joule-Thompson valve, Venturi device, liquid expander, hydraulic turbine, and the like. Partially liquefied sub-cooled stream 10*a* is passed to a separator, e.g., surge tank 80 where the liquefied portion 15 is withdrawn from the process as LNG having a temperature corresponding to the bubble point pressure. The remaining vapor portion (flash vapor) stream 16 is used as fuel to power the compressor units and/or as a refrigerant in sub-cooling loop 6 as described below. Prior to being used as fuel, all or a portion of flash vapor stream 16 may optionally be passed from surge tank 80 to heat exchange areas 50 and 55 to supplement the cooling provided in such heat exchange areas. The flash vapor stream 16 may also be used as the refrigerant in refrigeration loop 5.

Referring again to FIG. 2, a portion of flash vapor 16 is withdrawn through line 17 to fill sub-cooling loop 6. Thus, a portion of the feed gas from feed gas stream 10 is withdrawn (in the form of flash gas from flash gas stream 16) for use as the refrigerant by providing into a secondary expansion cooling loop, e.g., sub-cooling loop 6. It will again be apparent that once sub-cooling loop 6 is fully charged with flash gas, only make-up gas (i.e., additional flash vapor from line 17) to replace losses from leaks is required. The make-up gas may consist of readily available gas such as the flash gas 16, the feed gas 10 or nitrogen gas from another source. Alternatively, the refrigerant for this closed sub-cooling loop 6 may consist of nitrogen or nitrogen-rich gas particularly where the feed gas to be liquefied is lean or rich in nitrogen. In sub-cooling loop 6, expanded stream 18 is discharged from expander 41 and drawn through heat exchange areas 55 and 50. Expanded flash vapor stream 18 (the sub-cooling refrigerant stream) is then returned to compression unit 90 where it is re-compressed to a higher pressure and warmed. After exiting compression unit 90, the re-compressed sub-cooling refrigerant stream is cooled in ambient temperature cooler 31, which may be of substantially the same type as cooler 30. After cooling, the re-compressed sub-cooling refrigerant stream is passed to heat exchange area 50 where it is further cooled by indirect heat exchange with expanded refrigerant stream 13, sub-cooling refrigerant stream 18, and, optionally, flash vapor stream 16. After exiting heat exchange area 50, the re-compressed and cooled sub-cooling refrigerant stream is expanded through expander 41 to provide a cooled stream which is then passed through heat exchange area 55 to sub-cool the portion of the feed gas stream to be finally expanded to produce LNG. The expanded sub-cooling refrigerant stream exiting from heat exchange area 55 is again passed through heat exchange area 50 to provide supplemental cooling before being re-compressed. In this manner the cycle in sub-cooling loop 6 is continuously repeated. Thus, in one or more embodiments, the present method is any of the other embodiments disclosed herein further comprising providing cooling using a closed loop (e.g., sub-cooling loop 6) charged with flash vapor resulting from the LNG production (e.g., flash vapor 16).

It will be apparent that in the embodiment illustrated in FIG. 2 (and in the other embodiments described herein) that as feed gas stream 10 passes from one heat exchange area to another, the temperature of feed gas stream 10 will be reduced until ultimately a sub-cooled stream is produced. In addition, as side streams (such as stream 11) are taken from feed gas stream 10, the mass flow rate of feed gas stream 10 will be reduced. Other modifications, such as compression, may also be made to feed gas stream 10. While each such modification to feed gas stream 10 could be considered to produce a new and different stream, for clarity and ease of illustration, the feed gas stream will be referred to as feed gas stream 10 unless otherwise indicated, with the understanding that passage through heat exchange areas, the taking of side streams, and other modifications will produce temperature, pressure, and/or flow rate changes to feed gas stream 10.

As described above, the invention provides approximately 20% saving in installed horsepower and 10% saving in net horsepower or fuel usage from introducing supplemental cooling after indirect heat exchange cooling with ambient temperature air or water. Referring back to the chart of FIG. 1, line 2*b* represents an exemplary embodiment of the cooling system of the '351 application. The improvement of the present invention is expected to offset line 2*b* by from about 2 to about 10 percent or more, depending on the type of refrigerants and cycles used. In other words, the improved cooling cycle of the present disclosure is more efficient than the standard mixed refrigerant cycle up to process temperatures of about 80° F. to about 90° F., increasing the applicability of the improved process. Surprisingly, the reduced net horsepower of the present disclosure result from adding external cooling to the cycle.

Figure 3:
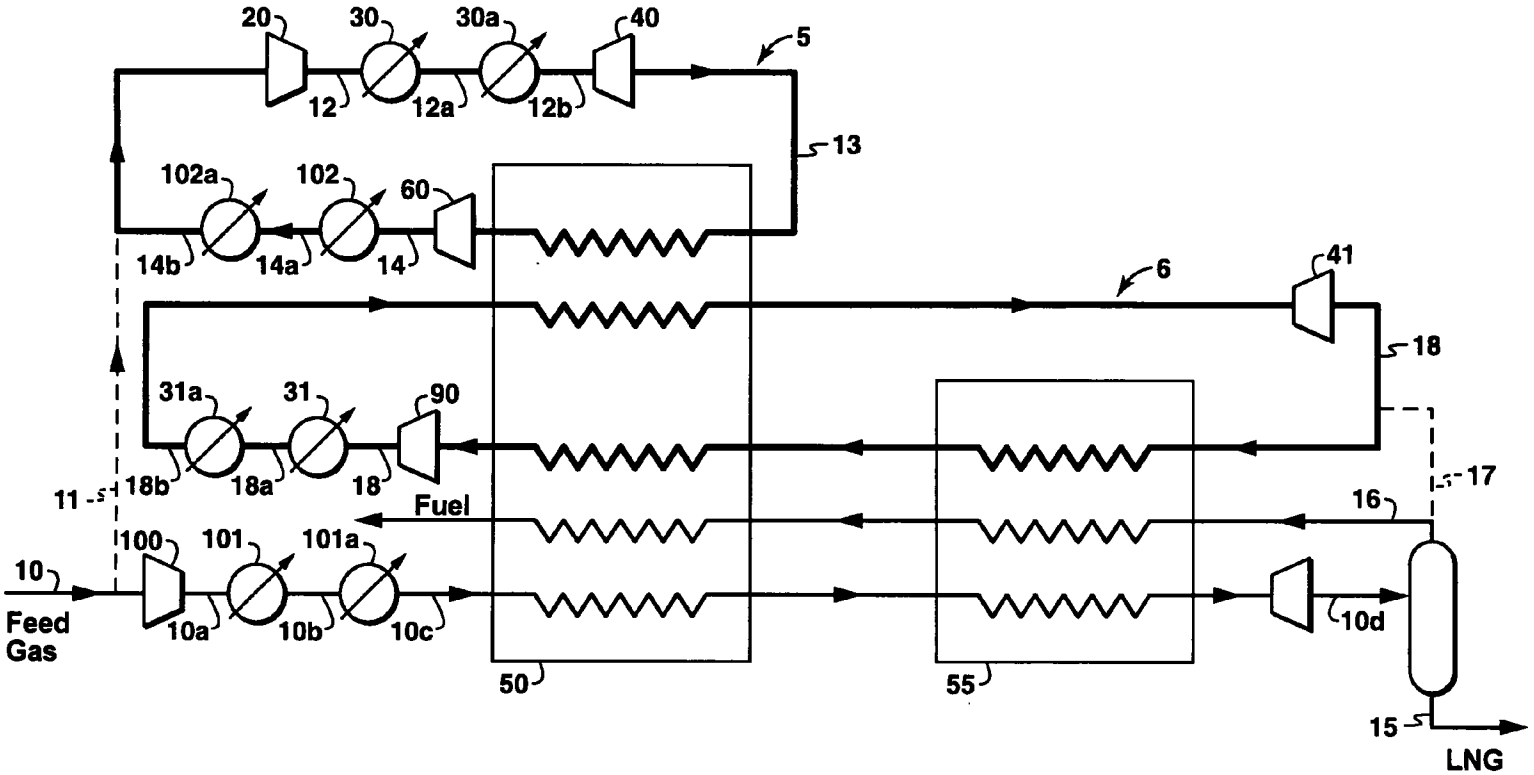
FIG. 3 is a schematic flow diagram of a second embodiment for producing LNG that is similar to the process shown in FIG. 2, except that multiple sites of supplemental cooling are provided to capture additional efficiencies.

Additional incremental efficiencies, particularly in net horsepower can be realized by introducing additional supplemental cooling as described at additional locations, preferably where indirect heat exchange with ambient air or water are used in the process. Thus in one embodiment additional supplemental cooling is applied to the refrigerant after compression in unit 60, or at least prior to one stage of compressing where the compressing in unit 60 comprises more than one compressing stage. For example, referring to FIG. 3, one or more supplemental cooling units 102 and 102*a* may be provided for refrigerant stream 14 between compressors 20 and 60, and preferably after one or more indirect heat exchange areas 102 providing cooling by ambient air or available water is also placed on refrigerant stream 14 between compressors 20 and 60. Cooling unit 31*a* may also be placed in the sub-cooling loop 6 after each of one or more compressors 90 for stream 18 that can be located at its warm end for increasing its pressure to the feed gas pressure, after having passed through one or more heat exchange areas (50 and 55). It is highly preferable to use initial cooling after each compressor by ambient temperature air or water heat exchange coolers, e.g., 31, with the supplemental cooling after each of the heat exchange coolers, but prior to its being expanded. Further, the process can be operated where said gas stream is compressed, cooled by subjecting to one or more ambient temperature cooling units, and then further cooled in a supplemental cooling unit, all before introduction into the heat exchange area 50. Specifically, the feed gas stream 10 can be compressed to a pressure higher than its delivery pressure in one or more compressors 100 prior to being cooled in heat exchange area 50, and if so, cooled initially after being compressed by both an ambient air or water heat exchange cooler 101 followed by a supplemental cooling unit 101*a* in accordance with the invention.

EXAMPLES

To illustrate the horsepower reduction available using the invention process, performance calculations and comparisons were modeled using Aspen HYSYS® (version 2004.1) process simulator, a product of Aspen Tech. The ambient air temperature was assumed to be 105° F. (40.6° C.) and the refrigerant in the high pressure refrigerant loop and all process streams was assumed to have been cooled to 100° F. (37.8° C.). In the first instance no supplemental cooling was added—Table 1.1 shows process data for this case. In the second, supplemental cooling was provided such that the refrigerant was reduced in temperature to 60° F. (15.6° C.) before the inlet to the refrigerant expander turbine—Table 1.1b shows the corresponding process data for this case. The installed horsepower reduction was calculated to be 21% for the high pressure refrigerant loop, contributing to a total facility installed horsepower reduction of 15.9%. Additional runs were conducted with supplemental cooling reducing the temperature over a range of 20° F. to 90° F. (−6.7° C. to 32.2° C.). As can be seen from Table 1 below, the installed horsepower reduction ranged from 4.5% to 23%. The corresponding reduction in net horsepower or fuel usage is up to 10%.

Table 1b shows the corresponding performance for the case where external refrigeration cooling is implemented not only at the expander inlet but after compression of all process streams and the feed gas stream. The maximum net horsepower saving is increased to over 11% and the installed horsepower saving is up to about 20%. A preferred embodiment is to cool only the expander inlet stream thereby obtaining the largest impact of savings for minimum process modification. However, other considerations may lead to a different optimum: for example, the choice of a mechanical refrigeration system that provides optimal refrigeration at a particular temperature level, availability of low price mechanical refrigerating equipment, or the value placed on the incremental fuel saving.

TABLE 1

Performance Data for 105° F. Ambient Temperature (Expander inlet cooling only)

| | Expander | HP refrigerant | Installed compression khp/MW | | | External refrigeration | Total | HP loop | % Facility Saving | |
|---|---|---|---|---|---|---|---|---|---|---|
| Process Temp (° F./° C.) | discharge pressure (psia/kPa) | flow rate (mmscfd/ kgmol/hr) | HP loop | Sub-cooling loop | External refrigeration loop | load (mmbtu/hr)/ (GJ/hr) | expander power (khp) | hP reduction (%) | net hP (or fuel usage) | Installed hP |
| 100/37.8 | 241/1658 | 1620/80695 | 251.1/187 | 57.1/42.5 | 0.0/0.0 | 0.0/0.0 | 96.1/71.6 | 0.0 | 0.0 | 0.0 |
| 90/32.2 | 261/1800 | 1584/78902 | 237.1/177 | 56.7/42.3 | 0.5/0.4 | 20.7/22 | 88.1/65.7 | 5.6 | 2.7 | 4.5 |
| 80/26.7 | 283/1951 | 1547/77059 | 222.9/166 | 56.5/42.1 | 1.6/1.2 | 42.2/45 | 80.5/60.0 | 11.2 | 5.5 | 8.8 |
| 70/21.1 | 300/2068 | 1496/74518 | 209.5/156 | 56.6/42.2 | 3.2/2.4 | 63.6/67 | 73.1/54.5 | 16.6 | 7.5 | 12.6 |
| 60/15.6 | 302/2082 | 1409/70185 | 197.4/147 | 56.7/42.3 | 5.1/3.8 | 80.5/85 | 65.9/49.1 | 21.4 | 8.8 | 15.9 |
| 50/10.0 | 304/2096 | 1328/66150 | 186.1/139 | 57.0/42.5 | 7.6/5.6 | 95.6/101 | 59.4/44.3 | 25.9 | 9.8 | 18.6 |
| 40/14.4 | 305/2103 | 1253/62414 | 175.8/131 | 57.3/42.7 | 10.4/7.8 | 109.2/115 | 53.5/39.9 | 30.0 | 10.4 | 21.0 |
| 30/−1.1 | 306/2110 | 1192/59375 | 167.8/125 | 57.5/42.9 | 13.9/10.3 | 121.2/128 | 48.5/36.2 | 33.2 | 10.1 | 22.4 |
| 20/−6.7 | 307/2117 | 1135/56536 | 160.4/120 | 5.7/43.0 | 17.9/13.3 | 134.2/142 | 44.0/32.8 | 36.1 | 9.5 | 23.4 |

TABLE 1b

Performance Data for 105° F. Ambient Temperature (Cooling all process streams)

| | Expander | HP refrigerant | Installed compression khp/MW | | | External | Total | HP loop | | |
|---|---|---|---|---|---|---|---|---|---|---|
| Process Temp (° F.) | discharge pressure (psia) | flow rate (mmscfd/ kgmol/hr) | HP loop | Sub-cooling loop | External refrigeration loop | refrigeration load (mmbtu/hr/ GJ/hr) | expander power (khp) | hP reduction (%) | % Facility Saving net hP (or fuel usage) | Installed hP |
| 100/37.8 | 241/1658 | 1620/80695 | 251.1/187 | 57.1/42.5 | 0.0/0.0 | 0.0/0.0 | 96.1/71.6 | 0.0 | 0 | 0 |
| 90/32.2 | 261/1800 | 1587/79051 | 231.6/173 | 56.4/42.0 | 2.1/1.6 | 84.4/89 | 88.2/65.6 | 7.8 | 4.8 | 5.9 |
| 80/26.7 | 283/1951 | 1554/77407 | 213.6/159 | 55.3/41.2 | 6.2/4.6 | 168.6/178 | 80.8/60.2 | 14.9 | 8.3 | 10.7 |
| 70/21.1 | 300/2068 | 1497/74568 | 196.0/146 | 54.1/40.4 | 12.49.3 | 248.5/262 | 73.2/54.6 | 21.9 | 10.6 | 14.8 |
| 60/15.6 | 302/2082 | 1406/70035 | 180.0/134 | 53.0/39.5 | 20.5/15.3 | 319.8/337 | 65.8/49.0 | 28.3 | 11.5 | 17.7 |
| 50/10.0 | 304/2096 | 1328/66150 | 166.0/124 | 51.9/38.7 | 30.7/22.9 | 387.6/409 | 59.4/44.3 | 33.9 | 10.9 | 19.3 |
| 40/4.4 | 305/2103 | 1255/62514 | 153.0/114 | 50.9/37.9 | 43.2/32.2 | 451.8/477 | 53.6/40.0 | 39.1 | 9.1 | 19.8 |
| 30/−1.1 | 306/2110 | 1191/59835 | 141.2/105 | 49.7/37.1 | 58.2/43.4 | 513.6/542 | 48.5/36.2 | 43.8 | 5.8 | 19.1 |
| 20/−6.7 | 307/2117 | 1141/56835 | 130.5/97 | 48.6/36.2 | 76.2/56.8 | 574.1/606 | 44.0/32.8 | 48.0 | 1.1 | 17.2 |

In a further example, the ambient temperature was fixed at 65° F. (18.3° C.) and the supplemental cooling was operated to cool the refrigerant stream and the process streams to temperatures ranging from 50° F. (10° C.) to 10° F. (−12.2° C.). The corresponding power reduction for the high pressure refrigerant loop ranged up to 33% representing an overall installed horsepower reduction of up to 14%.

TABLE 1.1

Aspen HYSYS ® Simulation data - no supplemental cooling

| State Point | Temperature (° F./° C.) | Pressure (psia/kPa) | Flow (mmscfd/kgmol/hr) |
|---|---|---|---|
| 10b | 100/37.8 | 1500/10342 | 637/31730 |
| 14b | 100/37.8 | 1500/10342 | 1620/80695 |
| 12a | 100/37.8 | 3000/20864 | 1620/80695 |
| 13 | −161/−107 | 241/1662 | 1620/80695 |
| 10d | −262/−163 | 18/124 | 637/31730 |
| 16 | −262/−163 | 18/124 | 57/2839 |
| 18a | 100/37.8 | 1500/10342 | 246/12254 |

TABLE 1.1b

Aspen HYSYS ® Simulation data - supplemental cooling (expander inlet only)

| State Point | Temperature (° F./° C.) | Pressure (psia/kPa) | Flow (mmscfd/kgmol/hr) |
|---|---|---|---|
| 10b | 100/37.8 | 1500/10342 | 637/31730 |
| 14b | 100/37.8 | 1500/10342 | 1409/70185 |
| 12a | 100/37.8 | 3007/20733 | 1409/70185 |
| 12b | 60/15.6 | 3000/20684 | 1409/70185 |
| 13 | −161/−107 | 302/2082 | 1409/70185 |
| 10d | −262/−163 | 18/124 | 637/31730 |
| 16 | −262/−163 | 18/124 | 57/2839 |
| 18a | 100/37.8 | 1500/10342 | 246/12254 |

I claim:

1. A process for liquefying a gas stream rich in methane, said process comprising:

(a) providing said gas stream at a pressure less than 1,000 pounds per square inch absolute (psia);

(b) withdrawing a portion of said gas stream for use as a refrigerant;

(c) compressing said refrigerant to a pressure greater than 3,000 pounds per square inch absolute (psia) to provide a compressed refrigerant;

(d) cooling said compressed refrigerant by indirect heat exchange with an ambient temperature air or water to a process temperature above about 50 degrees Fahrenheit (° F.) (10° C.);

(e) subjecting the cooled, compressed refrigerant to supplemental cooling so as to reduce further its temperature thereby producing a supplementally cooled, compressed refrigerant, wherein the supplementally cooled, compressed refrigerant of (e) is from 10° F. to 70° F. (6° C. to 39° C.) cooler than said process temperature resulting in a supplementally cooled, compressed refrigerant temperature from −35° F. to 60° F. (−37.2 to 15.6° C.);

(f) expanding the supplementally cooled, compressed refrigerant of (e) to further cool said refrigerant, thereby producing an expanded, supplementally cooled refrigerant;

(g) passing said expanded, supplementally cooled refrigerant to a heat exchange area; and (h) passing said gas stream through said heat exchange area to cool at least part of said gas stream by indirect heat exchange with said expanded, supplementally cooled refrigerant, thereby forming a cooled fluid stream, (i) passing said cooled fluid stream of (h) to a further heat exchange area for further cooling;

(j) withdrawing said cooled fluid stream after cooling in (i) and expanding said fluid stream for even further cooling, thereby producing an expanded, cooled fluid stream;

(k) passing said expanded, cooled fluid stream in (j) to a separator where a cooled liquid portion is withdrawn as liquefied natural gas and a vapor portion is withdrawn as a cooled vapor stream;

(l) passing said cooled vapor stream as a supplemental refrigerant back through the heat exchange areas of (i) and (g), wherein a portion of the cooled vapor stream from (k) is withdrawn prior to passing through the heat exchange area of (i) for use as a supplemental refrigerant by providing the portion of the cooled vapor stream to a secondary expansion loop which passes through the heat exchange areas of (i) and (h), is compressed after exiting heat exchange area of (h), subjected to ambient temperature cooling, optionally cooled by passing back through the heat exchange area of (h), then expanded for further cooling and re-introduction into the heat exchange areas of (i) and (g), and at least a 10% saving in net horsepower or fuel usage is provided by: (i) high pressure heat exchange of steps (c), (d), and (e), and (ii) utilizing the cooled vapor stream from step (k) as a supplemental refrigerant, when compared to a similar processes that does not utilize (i) and (ii).

2. The process of claim 1 wherein the ambient temperature in (d) is greater than 60° F. (15.6° C.).

3. The process of claim 1 wherein the ambient temperature in (d) is greater than 70° F. (21.1° C.).

4. The process of claim 1 wherein additional supplemental cooling is applied to the refrigerant prior to the compressing in (c), or at least prior to one stage of compressing where the compressing of (c) comprises more than one compressing stage.

5. The process of claim 1 wherein the portion of the cooled vapor stream is subjected to supplemental cooling after being subjected to ambient temperature cooling but prior to being passed back through the heat exchange area of 1(h).

6. The process of claim 1 wherein the expanded, supplementally cooled refrigerant is compressed after exiting heat exchange area of 1(h), subjected to ambient temperature cooling, optionally cooled by passing back through the heat exchange area of 1(h), then expanded for further cooling and re-introduction into heat exchange areas 6(a) and 1(g).

7. The process of claim 5, wherein the expanded, supplementally cooled refrigerant consists essentially of nitrogen or a nitrogen-rich gas.

8. The process of claim 1, wherein said gas stream of 1(a) is compressed, cooled by subjecting to one or more ambient temperature cooling units, and then further cooled in a supplemental cooling unit, all before introduction into the heat exchange area of 1(h).

9. The process of claim 1, wherein the supplemental cooling unit is an external refrigeration unit utilizing external refrigerants, wherein the external refrigerants are substantially independent of the portion of said gas stream for use as a refrigerant of 1(b).

10. The process of claim 1, wherein the only external refrigerant utilized is the indirect heat exchange with an ambient temperature air or water in step (d).

* * * * *